United States Patent [19]

Snyder, Jr. et al.

[11] 4,147,400

[45] Apr. 3, 1979

[54] CONTACT RETENTION DEVICE

[75] Inventors: Clair W. Snyder, Jr., Hellam; Clarence L. Paullus, Lewisberry; Paul B. Derr, Middletown, all of Pa.

[73] Assignee: AMP Incorporated, Harrisburg, Pa.

[21] Appl. No.: 879,576

[22] Filed: Feb. 21, 1978

[51] Int. Cl.[2] ..... H01R 13/40

[52] U.S. Cl. ..... 339/217 S

[58] Field of Search ..... 339/59 R, 59 M, 217 S

[56] References Cited

U.S. PATENT DOCUMENTS

| | | | |
|---|---|---|---|
| 3,091,746 | 5/1963 | Winkler | 339/217 S |
| 3,530,424 | 9/1970 | Gregory | 339/59 M |
| 4,045,110 | 8/1977 | Sterken | 339/217 S |

*Primary Examiner*—Gerald A. Dost

*Attorney, Agent, or Firm*—Russell J. Egan

[57] ABSTRACT

A contact retention device is disclosed for positively retaining a contact within a housing in such manner that no special insertion or extraction tools are required to respectively mount and dismount the contact and which will provide an audible indication when the contact is positively latched properly. The subject retention device includes a spring member having one end mounted fixedly in a connector housing and the other end spring biased against a free end of a blade contact with a portion of the spring member projecting beyond the end of the contact to form a contact release tab. The retention device not only serves to secure the contact within the housing but it adds to the resilience of the contact to bias it into engagement with a mating contact.

3 Claims, 6 Drawing Figures

Fig. 1
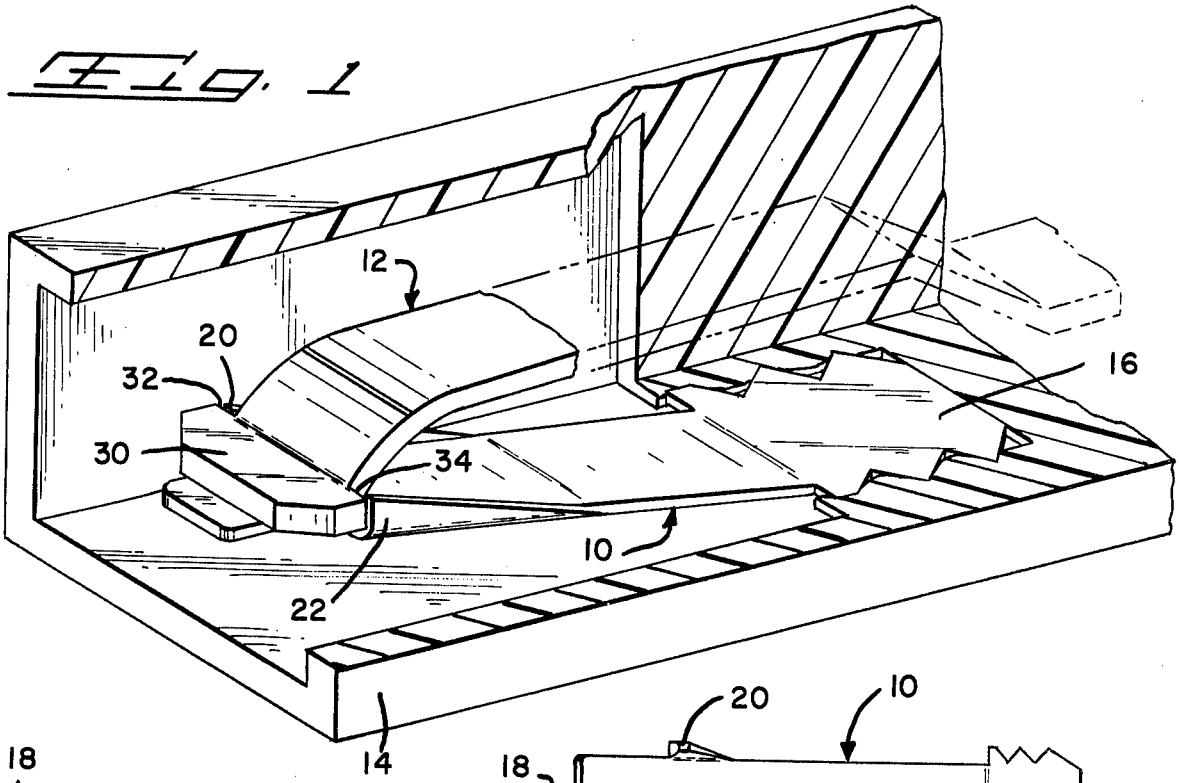
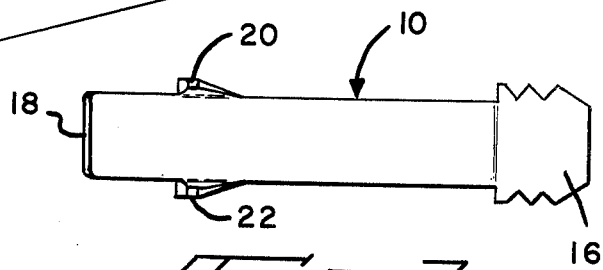
Fig. 2
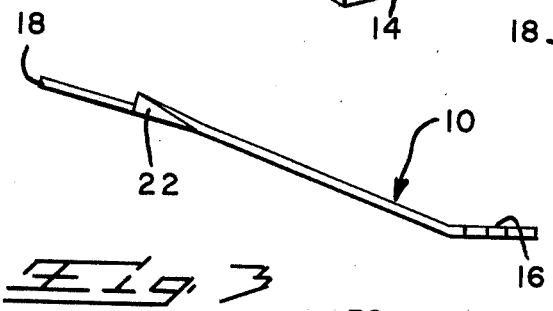
Fig. 3
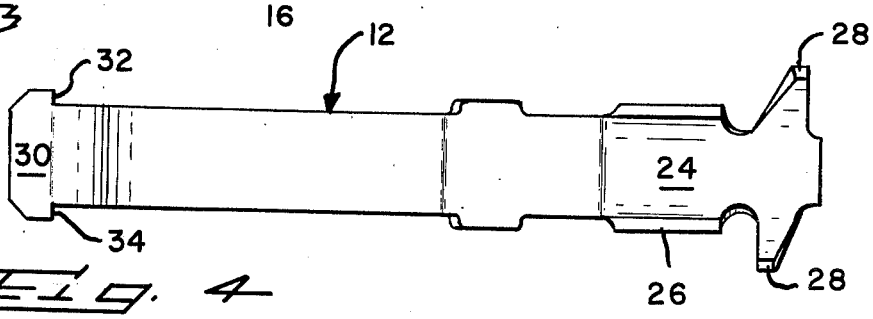
Fig. 4
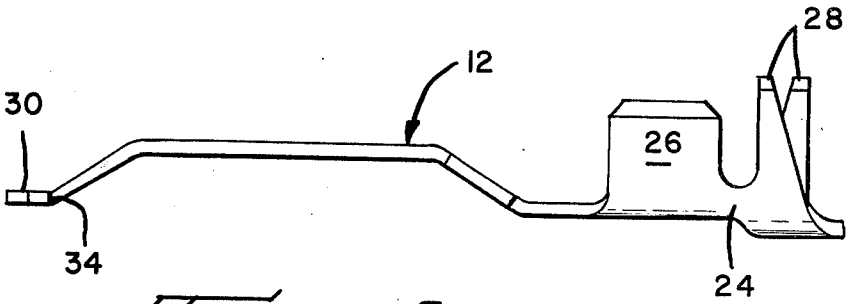
Fig. 5

CONTACT RETENTION DEVICE

BACKGROUND OF THE INVENTION

1. The Field Of The Invention

The present invention pertains to a spring device for retaining an electrical contact in a housing and in particular to a retention device which requires no special tools to operate and provides a positive indication of correct operation.

2. The Prior Art

It is well known in the electrical connector industry to have a variety of schemes provided for achieving both front and rear release of contacts from connector housings. Examples of front release contacts can be found in U.S. Pat. Nos. 3,058,091 and 3,513,438 and examples of rear release contacts can be found in U.S. Pat. No. 3,705,376. Generally all of the known contacts of this type require some sort of specialized tooling to effect the contact release. Examples of such tools can be found in U.S. Pat. Nos. 3,818,569 and Des. 220,377. The present invention obviates the need for such special tooling.

SUMMARY OF THE INVENTION

The present invention concerns a contact retention device formed by an elongated spring member and having a first end fixedly received in an electrical connector housing and a second end making spring biased engagement with a portion of a corresponding blade electrical contact. A portion of the device projects beyond the end of the associated contact and is available to effect release of the contact allowing the removal thereof from the associated connector housing.

It is therefore an object of the present invention to produce an improved contact retention device which will allow for mounting of a contact in a connector housing and for the dismounting of the contact without requiring the use of specialized insertion and/or extraction tooling.

It is another object of the present invention to produce a contact retention device which will provide an audible and/or tactile indication of proper seating of an associated contact.

It is a further object of the present invention to produce a contact retention device which will act in cooperation with the associated electrical contact to enhance the spring characteristics thereof.

It is a further object of the present invention to produce an improved electrical contact retention device which can be readily and economically produced.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 1 is a detailed perspective view of the subject contact retention device mounted in a portion of a housing and cooperating with an associated blade contact;

FIG. 2 is a plan view of the subject retention device;

FIG. 3 is a side elevation of the subject contact retention device;

FIG. 4 is a plan view of a blade electrical contact suitable for use with the present invention;

FIG. 5 is a side elevation of the contact of FIG. 4; and

DETAILED DESCRIPTION OF THE PREFERRED EMBODIMENT

Figure 6:
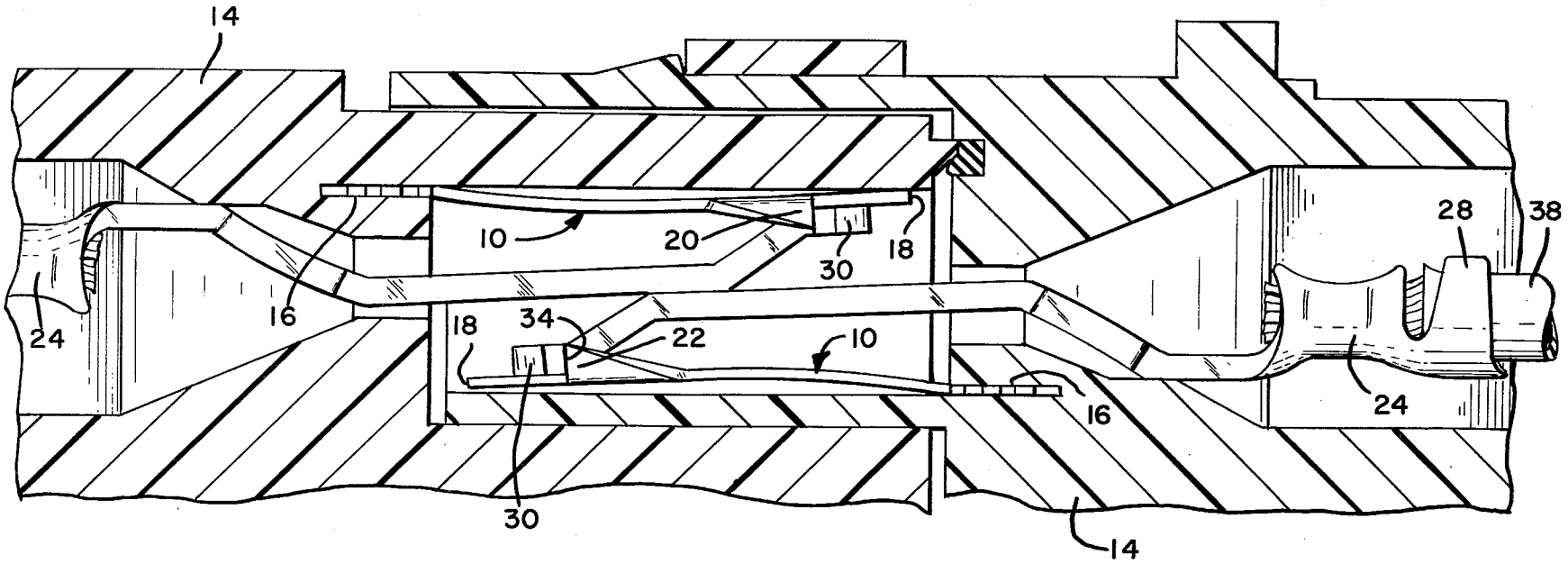
FIG. 6 is a vertical longitudinal section through mated electrical connector members in which the contacts have been furnished with the contact retention device of the present invention.

The subject contact retention device 10 can be used with almost any flat blade electrical terminal 12 and suitable housing 14. For example, U.S. Pat. No. 3,337,836 shows an electrical connector of the type which would profit from the use of the subject device. The connector of this reference has a pair of hermaphroditic housings, either of which can serve as a plug or receptacle and can be fixedly mounted in a bulkhead, with a plurality of blade terminals mounted in cantilever fashion in the respective housings to mate with a surface to surface engagement. The subject retention device can either be retrofitted into such existing connectors or designed into new connectors.

The subject retention device 10 is a metallic spring member having on one end a saw tooth profiled foot 16 suitable for grippingly engaging in an electrical connector housing 14, a profiled release tab 18 on the opposite end, and a pair of latching ears 20, 22 spaced from the release tab. It will be noted from FIG. 3 that the ears 20, 22 are bent upwardly from the plane of the device 10 while the foot 16 is likewise angled so that the device will have a spring biasing effect on the associated contact 12.

A representative blade contact 12, suitable for use with the present invention, is shown in FIGS. 4 and 5. The conductor engaging end 24 of the contact 12 is shown with a pair of conductor engaging crimp tabs 26 and a pair of insulation engaging crimp tabs 28. If desired, a pair of stabilizing tabs (not shown) could be included or the entire conductor engaging end could be profiled for insulation displacing conductor engagement as shown, for example, in U.S. Pat. No. 3,937,549. The mating end portion 30 of the contact is profiled in a suitable fashion and is provided with latching shoulders 32, 34.

The retention device 10 is mounted in a connector housing 14 with the foot 16 being received in a cavity 36 in a force fit manner. The contact 12 is suitably crimp connected to a conductor 38, in known fashion, and inserted through the rear of the housing 14 through a contact passage 40 until the forward end of the contact projects to a position where the shoulders 32, 34 can be appropriately engaged by the latches 20, 22, respectively. When the latches seat on the respective shoulders, there will be both an audible and tactile indication. The release tab 18 will project slightly beyond the end of the mating end 30 of the contact also providing a visual indication of proper positioning.

FIG. 6 illustrates the biasing force that the retention device exerts on the contacts. In an engaged position, the mating surfaces of the contacts engage to improve the performance thereof.

When it is desired to remove a contact from an associated housing, this is accomplished simply by depressing the release tab 18 sufficiently to free the latches 20, 22 from the shoulders 32, 34 and to pull the conductor 38 to the rear thereby removing the contact 12 from the housing 14.

The present invention may be subject to many changes and modifications without departing from the spirit or essential characteristics thereof. The present embodiment should therefore be considered in all respects as illustrative and not restrictive of the scope of the invention.

What is claimed is:

1. A contact retention device for use in combination with an electrical connector housing and a blade-like electrical contact received therein, said device comprising:

a cantilever spring member having a first end fixedly secured in said housing, a profiled release tab on the free end of said member and a pair of latching ears projecting from one surface of said member spaced from said release tab, said latching ears being adapted to engage with shoulders of said contact and said release tab projecting beyond the end of said contact whereby the contact is retained in said housing by engagement of said ears with said shoulders and said contact is released simply by depressing the release tab to disengage said latches from said shoulders.

2. In combination with a blade contact mounted in a connector housing in cantilever fashion, a retention device comprising:

an elongated member of spring material having a first end profiled to frictionally engage in said housing and a second end having a release tab extending beyond the free end of said blade contact and latching means spaced from said release tab and adapted to engage said contact, said member having a permanent bend intermediate its ends to constantly bias said second end into engagement with said contact whereby said contact is fully seated when engaged by said latching means of said member and is released by depressing said tab to free said latches.

3. The combination according to claim 2 wherein:

said blade contact includes a pair of shoulders spaced from its leading end; and said latching means includes a pair of tabs projecting from said member to engage said shoulders.

* * * * *